US006371222B1

(12) United States Patent
Andersson et al.

(10) Patent No.: US 6,371,222 B1
(45) Date of Patent: Apr. 16, 2002

(54) HAMMER DEVICE

(75) Inventors: Kurt Andersson, Tyresö; Jörgen Rodert, Saltsjö-Boo, both of (SE)

(73) Assignee: Atlas Copco Rock Drills AB, Orebro (SE)

( * ) Notice: Subject to any disclaimer, the term of this patent is extended or adjusted under 35 U.S.C. 154(b) by 0 days.

(21) Appl. No.: 09/673,055

(22) PCT Filed: Apr. 7, 1999

(86) PCT No.: PCT/SE99/00566

§ 371 Date: Oct. 10, 2000

§ 102(e) Date: Oct. 10, 2000

(87) PCT Pub. No.: WO99/54094

PCT Pub. Date: Oct. 28, 1999

(30) Foreign Application Priority Data

Apr. 21, 1998 (SE) ..... 9801380

(51) Int. Cl.[7] ..... E21B 1/00

(52) U.S. Cl. ..... 175/135; 175/189; 175/296; 173/136; 173/138; 173/200

(58) Field of Search ..... 175/296, 135, 175/162, 173, 189, 293, 321, 322; 173/90, 114, 200, 206, 136, 138

(56) References Cited

U.S. PATENT DOCUMENTS 5,207,280 A * 5/1993 Rodert et al.
5,320,189 A * 6/1994 Rodert et al.
5,372,196 A 12/1994 Andersson
5,375,670 A * 12/1994 Ekwall et al.

* cited by examiner

*Primary Examiner*—Roger Schoeppel
(74) *Attorney, Agent, or Firm*—Mark P. Stone

(57) ABSTRACT

A hammer device has a machine housing (1) with a hammer piston (2) movable to-and-fro. The to-and-fro movement of the hammer piston is controlled by a valve body (6) movable to-and-fro in the machine housing. The valve body, via a channel (7), alternatively connects a drive surface (5) on the hammer piston to a pressure source (8) and to low pressure (9). In order to expedite the actuation of the hammer piston at its rear dead center, the machine housing has a room (10) which is separated from the channel (7) by the hammer piston at the same time that the valve body (6) maintains the pressure from the pressure source (8) on the rear end surface (5) of the hammer piston.

1 Claim, 3 Drawing Sheets

HAMMER DEVICE

BACKGROUND OF THE INVENTION

The present invention relates to a hammer device, preferably for use in a rock drilling machine.

In a previously known hammer device of the above mentioned kind, see U.S. Pat. No. 5,372,196, a substantially higher impact frequency is obtained than in earlier known hammer devices. This solution has worked well regarding the impact frequency. One problem has been cavitation problems on the hammer piston at the drive surface for the return stroke of the hammer piston.

SUMMARY OF THE INVENTION

The present invention, which is defined in the subsequent claim, aims at achieving a hammer device where the high impact frquency is substantially maintained at the same time as the cavitation problems of the previously known hammer device are avoided.

BRIEF DESCRIPTION OF THE DRAWINGS

An embodiment of the invention is described below with reference to the accompanying drawings in which.

DESCRIPTION OF THE BEST MODES FOR CARRYING OUT THE INVENTION

Figure 1:
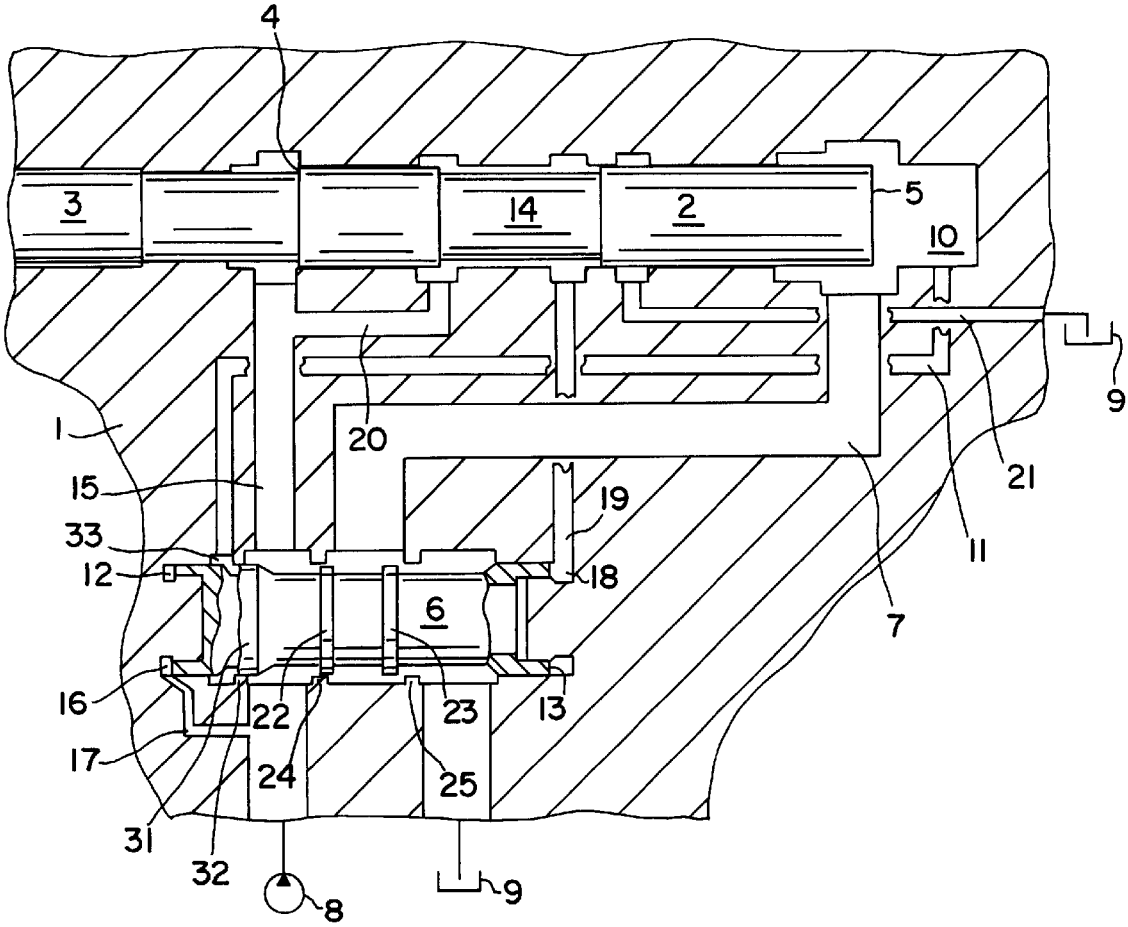
FIG. 1 shows a schematic section through the hammer device with the hammer piston in impact position.
Figure 2:
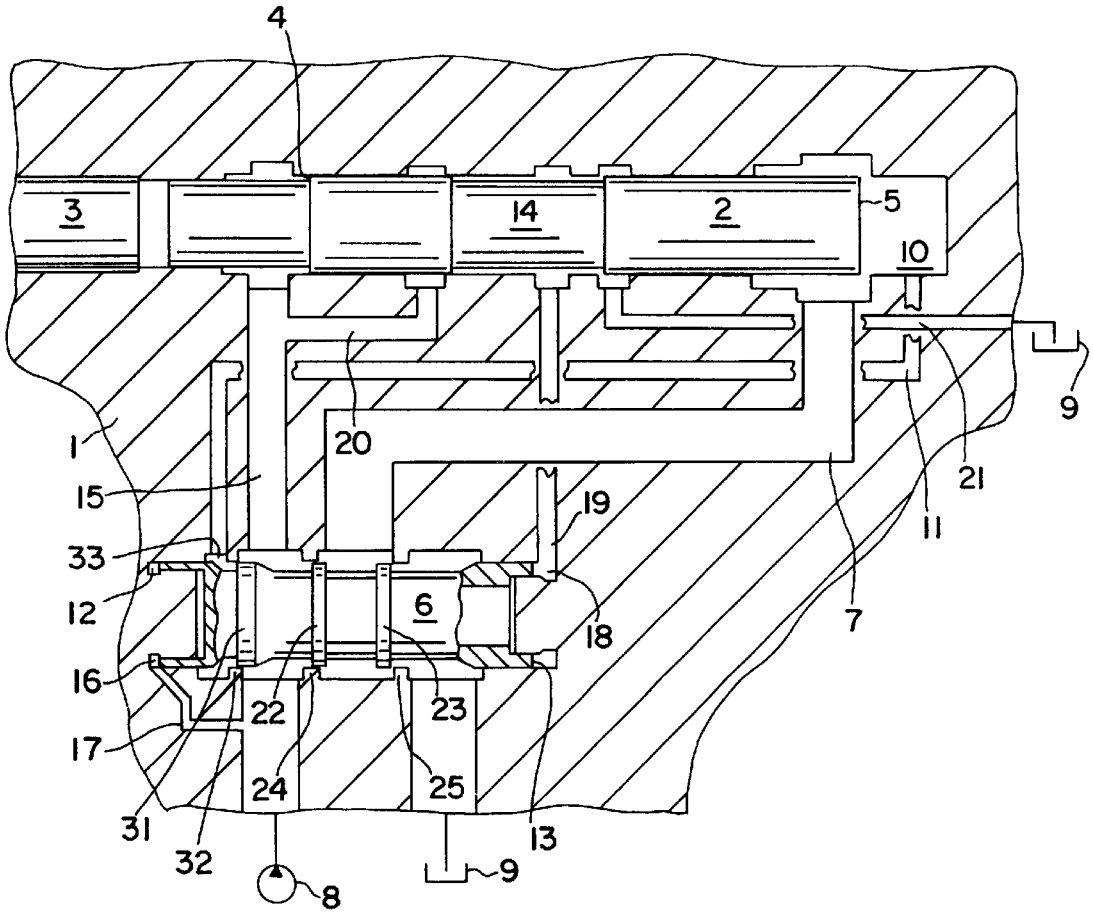
FIG. 2 shows a section with the hammer piston in another position.
Figure 3:
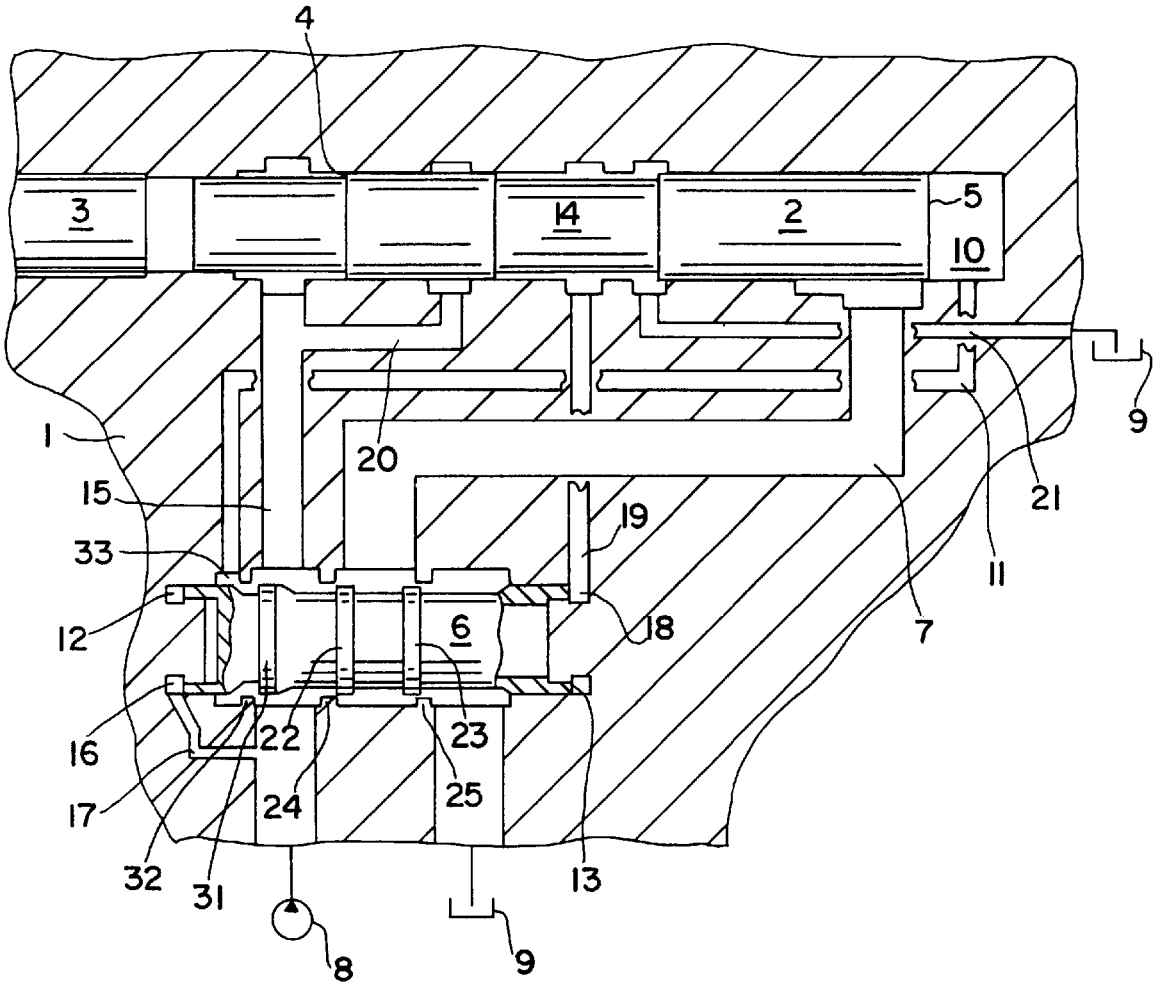
FIG. 3 shows a section with the hammer piston at its rearward end position.

The hammer device shown in the drawings comprises a machine housing 1 in which a hammer piston 2 is movable to-and-fro in order to exert a tool 3 for impacts. The tool is provided with a not shown drill bit in the usual manner. The hammer piston is provided with a first drive surface 4 which in the shown example is continuously pressurized by a pressure source 8 via a channel 15. The hammer piston is furthermore provided with a second drive surface 5 which in the shown example is the rear end surface of the hammer piston. Drive surface 5 is alternately connected to the pressure source 8 and to the low pressure of the tank 9 via a channel 7 and a valve body 6 movable to-and-fro in the machine housing. One can alternatively let the valve body connect both drive surfaces alternately to the pressure source or low pressure. In the shown example, pressurization of the first drive surface 4 strives at moving the hammer piston 4 to the right in the figure. Since the area of the second drive surface 5 is substantially larger than the area of the first drive surface 4 pressurization of the drive surface 5 results in the driving of the hammer piston to the left in the figure against the action of the pressure on drive surface 4. The valve body 6 is formed as a tubular slide provided with a first end surface 12 which is exerted to the pressure in a first chamber 16. Chamber 16 is via channel 17 connected with pressure source 8. Valve body 6 is furthermore provided with a second end surface 13 which is exerted to the pressure in a second chamber 18. Chamber 18 is via channel 19 connected with the cylinder bore of hammer piston 2. Since the first end surface 12 is continuously pressurized and the second end surface 13 is larger than the first, the movement to-and-fro of valve body 6 is controlled by the pressure changes in channel 19. In order to achieve these pressure changes, hammer piston 2 is provided with a part 14 with reduced diameter. Through this channel 19 is connected either to pressure source 8 via channels 20 and 15 as shown in FIG. 1, or via channel 21 to tank 9 as shown in FIGS. 2 and 3. The valve body is provided with three flanges 22,23 and 31 which cooperate with annular parts 24, 25 and 32 in the machine housing. The inner of valve body 6 is connected to low pressure, not shown. The machine housing 1 comprises a room 10 into which hammer piston 2 can enter so that it separates room 10 from channel 7. Room 10 is by means of a connection 11 connected with a chamber 33 about valve body 6. Flange 31 can in cooperation with he annular part 32 close the connection between pressure source 8 and chamber 33, FIGS. 1 and 2. Alternatively the connection between pressure source 8 and chamber 33 is opened. Through this, pressure fluid is supplied to room 10 during the working stroke of the hammer piston and the pressure from pressure source 8 is maintained when the drive surface 5 of hammer piston 2 is in room 10. A design according to the invention secures that connection 11 never is connected to tank 9. Through this, a substantially quicker braking of hammer piston 2 at the rear dead centre than what would be the case if channel 7 were to supply fluid to room 10 at the rear dead centre of hammer piston 2.

The impact device shown in the drawings works in the following way. In the position shown in FIG. 1, hammer piston 2 has just impacted on tool 3. Shortly before that, valve body 6 has moved to the position shown in FIG. 1, through pressure fluid supply from pressure source 8 via channels 15 and 20, the space about the part 14 with reduced diameter on the hammer piston, and channel 19 to chamber 18. In this position, room 10 is drained via channel 7 past valve body 6 to tank 9. This means that hammer piston 2 is driven to the right in the figure by the pressure on the first drive surface 4. When the hammer piston has come to the position shown in FIG. 2, the hammer piston has closed the connection between channel 20 and the space about the part 14 with reduced diameter on the hammer piston. Furthermore, the hammer piston has opened a connection between channel 19 and channel 21 through which chamber 18 is connected to tank 9. Valve body 6 then starts moving to the right in the figure. When hammer piston 2 has come to the position shown in FIG. 3, the hammer piston has separated room 10 from channel 7. Hammer piston 2 is now braked in room 10 since the pressure from pressure source 8 is maintained because connection 11 is not connected to tank 9 at any time. Shortly after the entrance of the rear drive surface 5 of hammer piston 2 into room 10, the connection between pressure source 8 and room 10 is opened via connection 11. In the position shown in FIG. 3, valve body 6 has closed the connection between channel 7 and tank 9. Furthermore a connection has been opened between pressure source 8 and channel 7. From the position shown in FIG. 3, hammer piston 2 is driven to the left in the figure toward the position shown in FIG. 1. On its way toward that position, the connection between channels 15 and 19 is opened so that the above described cycle is repeated.

What is claimed is:

1. Hammer device comprising a machine housing (1), a hammer piston (2) movable to-and-fro in the machine housing and intended to exert a tool (3) to impacts, the hammer piston comprising a first (4) and a second (5) drive surface intended to be pressurized to drive the hammer piston to-and-fro, a valve body (6) movable to-and-fro in the machine housing and arranged to connect at least the second (5) of said drive surfaces alternatively to a pressure source (8) or low pressure (9) via a channel (7) arranged in the machine housing, and a room (10) arranged in the machine housing (1), said room being separatable from said channel (7) by the hammer piston (2) for braking the return movement of the hammer piston (2), characterized by a connection (11) which connects said room (10) with said valve body (6), that said valve body (6) supplies pressure fluid to said room (10) during a working stroke of the hammer piston (2) and that said valve body (6) maintains the pressure from said pressure source (8) in said room (10) when the second drive surface (5) of the hammer piston (2) is situated in the room (10).

* * * * *